United States Patent [19]

Gebhard et al.

[11] Patent Number: 4,777,672

[45] Date of Patent: Oct. 18, 1988

[54] CHILDREN'S CONVERTIBLE TOILET APPARATUS

[75] Inventors: Albert W. Gebhard, Denver; William G. Au, Northglenn; James S. Gregg; Robert M. Parker, both of Aurora, all of Colo.

[73] Assignee: Gerico, Inc., Denver, Colo.

[21] Appl. No.: 893,583

[22] Filed: Aug. 6, 1986

[51] Int. Cl.[4] ..... A47K 11/02

[52] U.S. Cl. ..... 4/449; 4/239; 4/483; 182/21; 182/91; 297/130

[58] Field of Search ..... 4/235, 237, 239, 254, 4/480, 449, 460, 474, 476, 478, 479, 483; 182/21, 33.2, 91, 97; 297/118, 130, 232

[56] References Cited

U.S. PATENT DOCUMENTS

| | | | |
|---|---|---|---|
| 393,169 | 11/1888 | McGowen | 182/33.2 |
| 1,215,104 | 2/1917 | Bonner . | |
| 1,297,177 | 3/1919 | Johnson . | |
| 1,419,947 | 6/1922 | Schouten | 4/479 X |
| 1,492,798 | 5/1924 | Houston . | |
| 1,737,163 | 11/1929 | Keppinger | 4/239 |
| 1,739,366 | 12/1929 | Lang | 4/239 X |
| 1,752,499 | 4/1930 | Meath . | |
| 2,617,995 | 11/1952 | Wolcott, Jr. et al. . | |
| 2,667,802 | 2/1954 | Harris | 4/239 X |
| 2,682,914 | 8/1954 | Wing . | |
| 2,692,992 | 11/1954 | Thimmes et al. . | |
| 2,992,439 | 7/1961 | Van Tassel | 4/239 |
| 3,251,072 | 5/1966 | Breed | 4/239 |
| 3,829,908 | 8/1974 | Thomas | 4/483 X |
| 4,534,072 | 8/1985 | Lipski . | |

FOREIGN PATENT DOCUMENTS

| | | | |
|---|---|---|---|
| 280982 | 12/1914 | Fed. Rep. of Germany | 4/235 |
| 2161071 | 1/1986 | United Kingdom | 4/449 |

*Primary Examiner*—Charles E. Phillips
*Attorney, Agent, or Firm*—Sheridan, Ross & McIntosh

[57] ABSTRACT

A children's toilet apparatus is disclosed that is convertible from a free-standing potty chair to a toilet trainer that cooperates with a conventional toilet. The apparatus principally comprises a toilet seat member and adjustable legs which are pivotally interconnected. When employed as a free-standing potty chair, the leg members independently support the toilet seat member. When utilized as a toilet trainer, the leg members are oriented so that the toilet seat member is stabilized on and about the water closet seat of a conventional toilet by virtue of the interconnection of the toilet seat member and the leg members and contact of one of the leg members with a floor surface. In a preferred arrangement, one of the leg members is provided with a step member and hand grips to aid children in positioning themselves on top of the toilet seat member when the apparatus is employed as a toilet trainer.

11 Claims, 1 Drawing Sheet

CHILDREN'S CONVERTIBLE TOILET APPARATUS

FIELD OF INVENTION

The present invention relates to children's toilet devices, and more particularly to a self-contained apparatus that is convertible from a free-standing potty chair to a toilet trainer that cooperates with a conventional toilet.

BACKGROUND OF THE INVENTION

The use of free-standing potty chairs by young children is well known. Potty chairs provide a portable, and conveniently-sized toilet means for young children, and serve as preparatory appartuses in teaching young children to use conventional toilets.

Another device used in the teaching process is a toilet trainer which is designed to be supportably positioned on top of and cooperate with the water closet and/or seat of a conventional toilet. Such toilet trainers are provided with seats having apertures small enough to prevent young children from slipping through. Additionally, toilet trainers are available which include a step and, in some devices, hand grips to help young children position themselves on top of the toilet trainer seat.

Free-standing potty chairs and toilet trainers are most generally available as separate units. As a result, parents have incurred the expense and inconvenience of having both types of devices on hand. In the past, unitary, convertible potty chair and toilet trainer devices which have been made available have proven to be inadequate primarily from a stability and ease-of-use standpoint. Specifically, such convertible devices have not provided for a toilet trainer arrangement wherein the training device, when positioned upon the water closet and/or seat of a conventional toilet, is adequately stabilized on and about the water closet and/or seat. Additionally, known convertible devices have failed to provide a step means for children to use when positioning themselves upon a toilet trainer seat that is resting on top of the water closet and/or seat of a conventional toilet.

OBJECTS AND SUMMARY OF THE INVENTION

The primary object of the present invention is to provide a children's toilet apparatus which can be easily converted from a free-standing potty chair to a toilet trainer that cooperates with a conventional toilet, and which, when employed as a toilet trainer, is stabilized on and about the conventional toilet by leg means that directly contact a floor surface.

Another object of the present invention is to provide a convertible children's toilet apparatus wherein, when the apparatus is employed as a toilet trainer, an intermediate step is provided to help young children position themselves on top of the toilet trainer seat and to elevate young boys who desire to stand while utilizing a conventional toilet, and wherein such step is supported by leg means which directly contact a floor surface.

An additional object of the present invention is to provide a convertible children's toilet apparatus having hand grips which can be employed by young children to help them safely position themselves on top of a toilet trainer seat that is resting on top of a conventional toilet, and which hand grips can be used in transporting the apparatus.

Yet another object of the present invention is to provide a convertible children's toilet apparatus having leg means and a toilet seat member which are pivotally interconnected so that the apparatus can be conveniently and easily collapsed for compact storage and transportation.

In accordance with the present invention, a children's toilet apparatus is provided that can be converted from a free-standing potty chair to a toilet trainer that cooperates with a conventional toilet. The apparatus comprises first and second leg means and a toilet seat member which are all pivotally interconnected. The toilet seat member preferably includes a children's size toilet seat, a lid which is connected to the back portion of the seat, a removable receptacle positionable below an aperture in the seat, and a deflector shield provided in the front portion of the seat aperture. The toilet seat member and first and second leg means are designed and interconnected to be pivotally locatable in a first position wherein the first and second leg means directly contact a floor surface to cooperatively support the toilet seat member, thereby providing a free-standing potty chair.

The toilet seat member and first and second leg means are also designed and interconnected to be pivotally locatable in a second position wherein the seat of the toilet seat member can be positioned substantially on top of the seat of a conventional toilet to provide a toilet trainer. In this second position, the first and second leg means cooperate so that the toilet seat member is stabilized on and about the seat through the interconnection of the first and second leg means and contact of the second leg means with a floor surface. The first leg means is preferably provided with an intermediately positioned step member to help children position themselves on top of the toilet seat member when the apparatus is employed in connection with a conventional toilet, and to elevate young boys who stand while utilizing a conventional toilet. Such step member is sturdily supported by virtue of the interconnection of the first and second leg means, and through contact of the second leg means with a floor surface. The toilet seat member and first leg means are interconnected by means which permit the toilet seat member to be vertically adjusted within a range of heights when the apparatus is employed in the second position, thereby accommodating use with conventional toilets whose seats are at different heights relative to the corresponding floor surface. The first leg means also preferably comprises hand grips extending from the top end of the first leg means to help children in positioning themselves on top of the toilet seat member, and for use in transporting the apparatus.

The toilet seat member and first and second leg means are also designed and interconnected to be pivotally locatable in a third non-operative position for compact storage and easy transportation. In this position, the toilet seat member and first and second leg means are oriented so that their respective longitudinal axes are in substantially vertical alignment. The second leg means serves to support the apparatus through contact with a floor surface, and the above-referenced hand grips can be conveniently employed for lifting and transporting the apparatus. Additional features and advantages of the present invention can be ascertained from the drawings and detailed description presented hereinbelow.

DETAILED DESCRIPTION OF THE PREFERRED EMBODIMENT

Figure 1:
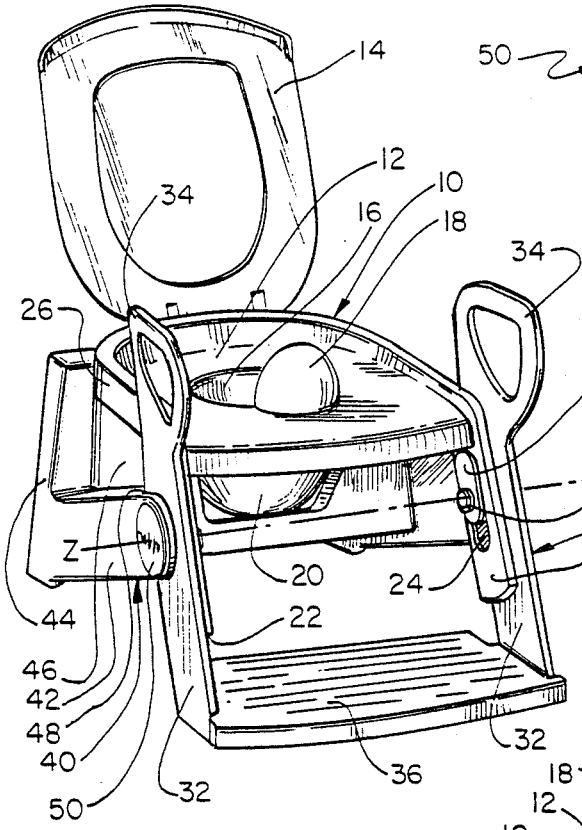
FIG. 1 is a perspective view of the preferred embodiment of the present invention wherein first and second leg means and a toilet seat member are positioned to provide a free-standing potty chair.
Figure 3:
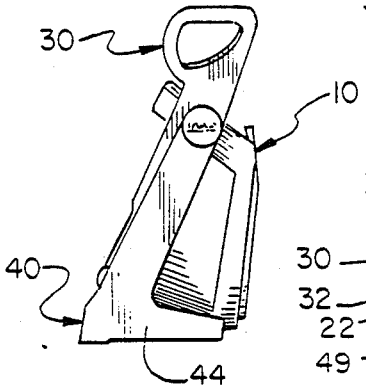
FIG. 3 is a side view of the preferred embodiment of the present invention wherein first and second leg means and a toilet seat member are positioned for convenient storage and transportation.
Figure 2:
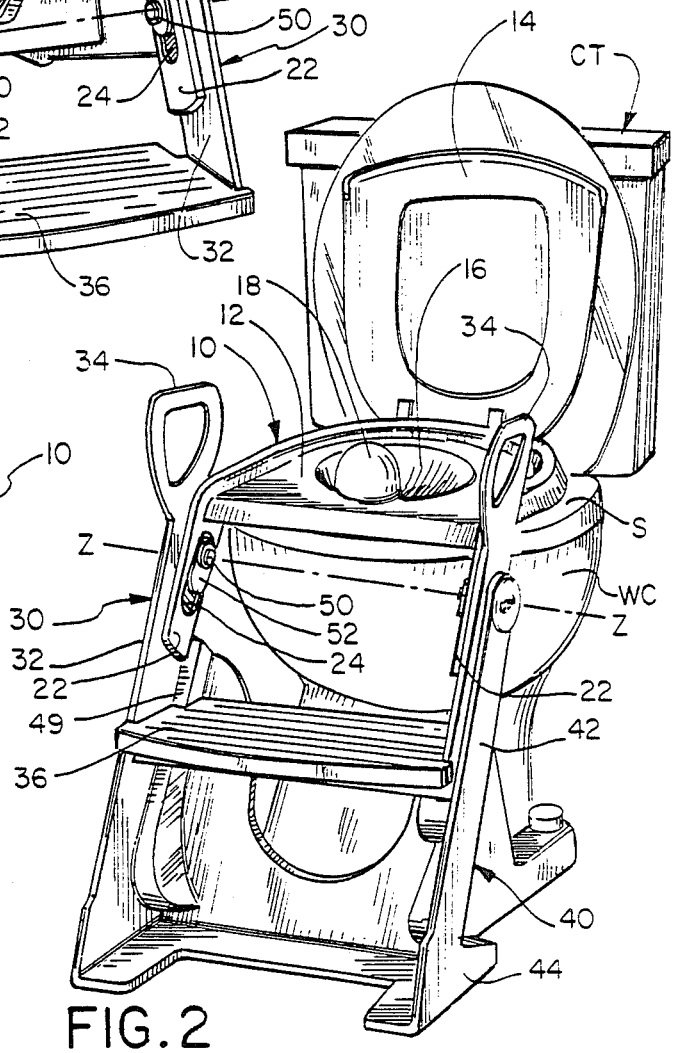
FIG. 2 is a perspective view of the preferred embodiment of the present invention wherein first and second leg means and a toilet seat member are positioned to provide a toilet trainer device that cooperates with a conventional toilet.

In accordance with the preferred embodiment of this invention, FIG. 1-FIG. 3 show the principal components of the apparatus oriented in three different positions. The principal components of the apparatus are a toilet seat member 10, a first leg means 30 and a second leg means 40.

Said toilet seat member 10 preferably comprises a seat 12 having a lid 14, an aperture 16, a removable deflector shield 18, a receptacle 20, and projections 22 having elongated slots 24. For comfort and safety purposes, the seat 12 may be appropriately contoured and the aperture 16 should be small enough to prevent a child from slipping through. The deflector shield 18 should be selectively connectable to the seat 12 adjacent to the forward portion of the aperture 16 for use and cleaning when necessary. The receptacle 20 should also be removable from the seat 12 for easy cleaning. The lid 14 may be hingedly connected to the seat 12 for selective open and closed positioning.

Said first leg means 30 can be defined by longitudinal members 32 having hand grips 34 located at the top ends thereof. The longitudinal members 32 should be further provided with lateral apertures (not shown), for the interconnection purposes discussed hereinbelow. A horizontal step member 36 is preferably attached to the bottom ends of said longitudinal members 32, and may be provided with raised ridges to prevent children from slipping off. Said second leg means 40 can be principally defined by leg members 42 and foot members 44. The leg members 42 should be provided with lateral apertures (not shown), for the interconnection purposes discussed hereinbelow.

Figure 4:
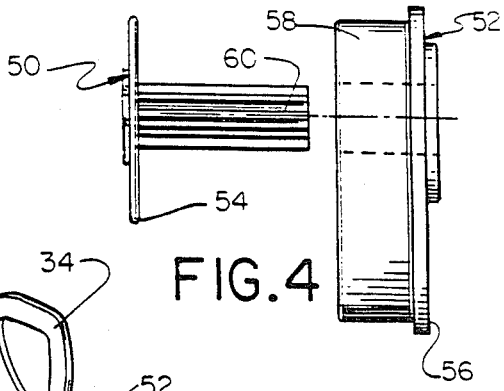
FIG. 4 illustrates a pin means and guide means that may be utilized to interconnect the principal components of the present invention.

To pivotally interconnect said toilet seat member 10, first leg means 30 and second leg means 40, and by way of example only, a pin means 50 and oblong guide means 52 may be utilized. As illustrated in FIG. 4, said pin means 50 and guide means 52 may be designed to have headed end portions 54 and 56, respectively. Said guide means 52 should be further provided with lateral apertures that can be located off-center towards one of the ends of the guide means 52, and should be designed so that the non-headed portions 58 thereof are positionable within said slots 24 of said projections 22. Said pin means 50 can be inserted through the apertures of the leg members 42 of the second leg means 40, the apertures of said longitudinal members 32 of the first leg means 30, and into the apertures of said guide means 52. To secure this assembly together, the non-headed ends 60 of pin means 50 can be provided with threaded recesses, and threaded screw members can be provided through the apertures of said guide means 52 for mating engagement with such recesses. Said guide means 52 and slots 24 may also be designed so that, when the apparatus is employed as a toilet trainer device, the toilet seat member 10 can be vertically and automatically adjusted relative to said guide means 52 at different heights within a range, as more fully discussed hereinbelow. It should be appreciated that the above-described manner for interconnecting the toilet seat member 10, first leg means 30 and second leg means 40 permits such components to pivot about a common lateral axis Z, and allows such components to be oriented in different positions, thereby providing a novel, convertible potty chair and toilet trainer apparatus.

As illustrated in FIG. 1, the toilet seat member 10, first leg means 30 and second leg means 40 may be pivotally located to provide a free-standing potty chair. In this arrangement, the seat 12 is supported by virtue of the interconnection of said projections 22 with said first leg means 30, and through contact between peripheral rim portions 26 of the seat 12 with the tops of side panels 46 and rear panels (not shown) of the second leg means 40. It is important to note that both the first leg means 30 and second leg means 40 are provided to contact a floor surface in this arrangement. As shown in FIG. 1, a first ledge 48 may be formed in the second leg means 40 for abutting engagement with the first leg means 30, thereby restricting the pivotal range of movement of said first and second leg means 30 and 40. As can be appreciated, said receptacle 20 should be employed in the use of the apparatus as a free-standing potty chair.

FIG. 2 illustrates the present invention when employed as a toilet trainer in connection with a conventional toilet CT. The first and second leg means 30 and 40 are pivotally located such that the second leg means 40 contacts a floor surface and vertically supports the first leg means 30 by virtue of the above-described interconnection. As previously noted, the height of the toilet seat member 10 can be adjusted within a range so that the seat 12 can rest firmly upon a a seat S of a water closet WC of the conventional toilet CT. Such range of heights will be determined by the length of the slots 24 and by the orientation of said guide means 52 within the slots 24. That is, when the apertures through guide means 52 are located off-center towards one of the ends of the guide means 52, the guide means 52 can be alternatively oriented within the slots 24 so that the solid ends of the guide means 52 extend upward or downward. The described automatic height adjustment feature accommodates use of the present invention where a floor surface is covered, for example, by carpet or the like adjacent to the conventional toilet CT.

As shown in FIG. 2, a second ledge 49 may be formed in the second leg means 40 for abutting engagement with the first leg means 30, thereby restricting the pivotal range of movement of said first and second leg means. In this arrangement, it is important to note that the first and second leg means 30 and 40 cooperate to stabilize the toilet seat member 10 on and about the seat S of water closet WC of the conventional toilet CT, thereby yielding substantial stabilization and ease-of-use advantages.

Of additional importance, and as further shown in FIG. 2, the step member 36 of the first leg means 30 is located at an intermediate height and is sturdily supported through the described interconnection with said second leg means 40. Consequently, young children may beneficially employ the step member 36 to help safely position themselves on top of the seat 12. Additionally, young boys may utilize step member 36 when standing up to utilize the conventional toilet CT. The hand grips 34 may also be employed by young children when positioning themselves on top of the seat 12.

When the apparatus is not being used as a free-standing potty chair or toilet trainer, the apparatus is designed to fold-up for compact storage and transportation (see FIG. 3). In this arrangement, the toilet seat member 10, first leg means 30 and second leg means 40 are all pivotally located so that their respective longitudinal axes are in substantially vertical alignment. As shown in FIG. 3, the foot members 44 of the second leg means 40 can be designed to support the apparatus through contact with a floor surface in this arrangement.

In the preferred embodiment of the invention, the components of the above-described apparatus are preferably made of no-tip molded plastic for safety and transportability purposes.

Based upon the above detailed description, salient features of the present invention can be easily recognized. The disclosed apparatus principally comprises a toilet seat member and leg means which can be convertibly adjusted to provide a free-standing potty chair and toilet trainer. When employed as a free-standing potty chair, first and second leg means cooperate to support the toilet seat member through the contact with a floor surface. When utilized as a toilet trainer, the first and second leg means and oriented so that the toilet seat member is stabilized on and about the water closet of a conventional toilet through the interconnection of the first and second leg means and contact of the second leg means with a floor surface. In that arrangement, the first leg means is preferably provided with a step member and hand grips to aid children in positioning themselves on top of the toilet trainer. In non-use, the principal components of the apparatus may be pivotally located in a handy, collapsed orientation for convenient storage and transportation.

What is claimed is:

1. An apparatus that is convertible from a free-standing potty chair to a toilet trainer that cooperates with a conventional toilet comprising:

a toilet seat member;

a first leg member; and a second leg member, said toilet seat member being pivotally interconnected to said first and second leg members, said first leg member being pivotally interconnected to said toilet seat member and said second leg member, and said second leg member being pivotally interconnected to said toilet seat member and said first leg member, whereby the pivotal interconnections allow for independent and relative pivotal movement of said toilet seat member and said first and second leg members about substantially parallel axes and allow for positioning the apparatus in a first position wherein said first and second leg members contact a first floor surface to cooperatively support said toilet seat member at a first height above said first floor surface, and said toilet seat member and first and second leg members all being pivotally interconnected for positioning in a second position wherein said toilet seat member is supportable by a conventional toilet and said second leg member contacts a second floor surface, with said toilet seat member being at a second height relative to said second floor surface when said apparatus is in said second position, and wherein said second height is different from said first height.

2. An apparatus as recited in claim 1, wherein said first leg member comprises hand grip means.

3. An apparatus as recited in claim 1, wherein said toilet seat member comprises a seat having an aperture and a removable receptacle that can be supportably positioned and centered substantially below said aperture.

4. An apparatus as recited in claim 3, wherein said toilet seat member further comprises a removable deflector shield that is connectable to said seat adjacent to a forward portion of said aperture.

5. An apparatus as recited in claim 1, wherein said toilet seat member and said first and second leg members are pivotally interconnected about a common lateral axis.

6. An apparatus that is convertible from a free-standing potty chair to a toilet trainer that cooperates with a conventional toilet comprising:

a toilet seat member;

a first leg member; and a second leg member, said toilet seat member and said first and second leg members being pivotally interconnected for positioning in a first position wherein said first and second leg members contact a first floor surface to cooperatively support said toilet seat member above said first floor surface, and said toilet seat member and first and second leg members being pivotally interconnected for positioning in a second position wherein said toilet seat member is supportable by a conventional toilet and said second leg member contacts a second floor surface and said first leg member further comprises a horizontal step member, and wherein, in said second position, said horizontal step member is vertically located at an intermediate height between said second floor surface and said toilet seat member.

7. An apparatus that is convertible from a free-standing potty chair to a toilet trainer that cooperates with a conventional toilet having a conventional toilet seat comprising:

a toilet seat member;

a first leg member; and a second leg member having a longitudinal axis and a foot member, said toilet seat member and said first and second leg members being pivotally interconnected for positioning in a first position wherein said first and second leg members contact a first floor surface to cooperatively support said toilet seat member above said first floor surface, and said toilet seat member and first and second leg members being pivotally interconnected for positioning in a second position wherein said toilet seat member is supportable by a conventional toilet and said foot member of said second leg member contacts a second floor surface, further comprising adjustment means for automatically adjusting the height of said toilet seat member relative to said second floor surface wherein, when said foot member is not operatively contacting said second floor surface, said second leg member is freely movable in a direction substantially along said longitudinal axis of said second leg member towards said second floor surface when said foot member is engaged during use of the apparatus by a child and wherein, when said toilet seat member is not operatively contacting the conventional toilet seat, said toilet seat member is freely movable towards the conventional toilet seat when engaged during use of the apparatus by the child.

8. An apparatus that is convertible from a free-standing potty chair to a toilet trainer that cooperates with a conventional toilet comprising:

a toilet seat member;

a first leg member; and a second leg member, said toilet seat member and said first and second leg members being pivotally interconnected for positioning in a first position wherein said first and second leg members contact a first floor surface to cooperatively support said toilet seat member above said first floor surface, and said toilet seat member and first and second leg members being pivotally interconnected for positioning in a second position wherein said toilet seat member is supportable by a conventional toilet and said second leg member contacts a second floor surface and wherein said toilet seat member and said first and second leg members are pivotally interconnected for positioning in a third position wherein the longitudinal axes of said toilet seat member and said first and second leg members are in substantially vertical orientation.

9. An apparatus that is convertible from a free-standing potty chair to a toilet trainer that cooperates with a conventional toilet having a conventional toilet seat comprising:

a toilet seat member; and a positionable leg member having a foot member, said positionable leg member connected to said toilet seat member, wherein said leg member is positionable in a first position to independently support said toilet seat member, and wherein said leg member is positionable in a second position relative to a floor surface wherein, when said foot member is not operatively contacting said floor surface, said leg member is freely movable relative to said toilet seat member in a direction substantially along the longitudinal axis of said leg member towards said floor surface when said foot member is engaged during use of the apparatus by a child until said foot member contacts said floor surface and wherein, when said toilet seat member is not operatively contacting the conventional toilet seat, said toilet seat member is freely movable towards the conventional toilet seat when engaged during use of the apparatus by the child.

10. An apparatus as recited in claim 9, wherein said leg member further comprises a step member, and wherein, when said leg member is positioned in said second position, said step member is located at an intermediate height between said toilet seat member and said floor surface.

11. An apparatus comprising:

a toilet seat member;

a first leg member; and a second leg member, said toilet seat member and said first and second leg members being pivotally interconnected for positioning in a first position wherein said first and second leg members contact a first floor surface to cooperatively support said toilet seat member above said first floor surface, and said toilet seat member and first and second leg members being pivotally interconnected for positioning in a second position wherein said toilet seat member is supportable by a conventional toilet and said second leg member contacts a second floor surface and wherein said toilet seat member and first and second leg members are interconnected to permit independent and relative pivotal movement of each of said toilet seat member and first and second leg members about a common axis

* * * * *